United States Patent [19]

Morrison

[11] 4,202,134

[45] May 13, 1980

[54] WATER TOY

[75] Inventor: Howard J. Morrison, Deerfield, Ill.

[73] Assignee: Marvin Glass & Associates, Chicago, Ill.

[21] Appl. No.: 856,349

[22] Filed: Dec. 1, 1977

[51] Int. Cl.[2] ..... A63H 23/10

[52] U.S. Cl. ..... 46/92; 46/22; 273/157 R

[58] Field of Search ..... 46/22, 30, 25, 16, 17, 46/92, 23, 91, 93; 273/156, 157 R

[56] References Cited

U.S. PATENT DOCUMENTS

| | | | |
|---|---|---|---|
| 1,234,883 | 7/1917 | Douglass | 46/17 |
| 1,976,664 | 10/1934 | Gantt | 273/157 R |
| 2,011,714 | 8/1935 | Friedman | 46/16 X |
| 3,835,583 | 9/1974 | Manning | 46/201 |

OTHER PUBLICATIONS

"Foam Fleet", Foamcraft Specialties, Inc., 3/10/1966.
Horchow Collection, p. 13, Jan. 1976.

*Primary Examiner*—Louis G. Mancene
*Assistant Examiner*—Mickey Yu
*Attorney, Agent, or Firm*—Mason, Kolehmainen, Rathburn & Wyss

[57] ABSTRACT

A water toy for children comprises a plurality of puzzle pieces formed of lightweight, floatable material and each puzzle piece includes one or more contoured edge portions which are shaped to removably interlock with a contoured edge portion of an adjacent puzzle piece like a jigsaw puzzle. The assembled puzzle pieces form the outer profile of an animal or other creature such as a whale, or the like, when they are assembled together with their contoured edge portions interlocked in a proper selected assembled relation. Each puzzle piece is of sufficient thickness so that while the pieces may slide relative to one another due to the water action, they will not become disassembled. Each of the individual puzzle pieces also includes on at least one side, an individual animated face and is shaped to present a particular real or imaginary animal such as a turtle, shark, seal, serpent or other creature.

19 Claims, 4 Drawing Figures

WATER TOY

BACKGROUND OF THE INVENTION

1. Field of the Invention

The present invention relates to water toys and more particularly relates to floating water toys wherein a plurality of puzzle pieces are provided to interlock together like a jigsaw puzzle and when so assembled, form the profile or shape of an animal or creature such as a whale, or the like. Individually, each puzzle piece is shaped to resemble a smaller, real or imaginary creature and at least one side of the pieces are decorated with an animated face.

2. Description of the Prior Art

A wide variety of water toys have been provided for young children to be used for play in the bathtub, wading pool, swimming pool or the like. Many of these toys resemble creatures such as birds, animals, fish, etc., and provide long hours of enjoyment for young children. As far as is known, no water toys have been provided which include a plurality of puzzle pieces formed of lightweight, floatable material and which are formed with a contoured edge portion shaped to removably interlock together with an adjacent puzzle piece so that when some or all of the pieces are assembled, the profile of a creature or animal such as a whale is formed.

Accordingly, it is an object of the present invention to provide a new and improved water toy of the character described.

Another object of the present invention is to provide a new and improved water toy of the character described which combines the interesting play features of a jigsaw puzzle with those of a water toy having a profile representing an animal, creature, or any other object.

Yet another object of the present invention is to provide a new and improved water toy of the character described wherein each of the puzzle pieces is also individually decorated on one side to provide an animated face and is shaped to represent a particular real or imaginary creature which may be different from the profile of the aquatic creature which is formed when all of the pieces are assembled together.

SUMMARY OF THE INVENTION

The foregoing and other objects and advantages of the present invention are accomplished in a new and improved water toy which comprises a plurality of puzzle pieces formed of lightweight, floatable material. Each of the puzzle pieces includes one or more contoured edge portions shaped to removably interlock with a contoured edge portion of an adjacent puzzle piece. The puzzle pieces are shaped to form the outer profile of an object or creature such as a whale or the like when they are properly assembled together with their contoured edge portions interlocked.

Each of the individual puzzle pieces includes a pair of opposite sides and has a substantial thickness therebetween so that the puzzle pieces do not easily become disassembled from one another when they are floating in a properly interlocked assembled condition in the water. As such, the pieces need not be tightfitting, which will permit some relative movement between the pieces as a result of the wave action. Each of the puzzle pieces is decorated with an individual animated face on one of its sides and is shaped to resemble an object or creature which may be different from the object or creature formed when the puzzle pieces are assembled together. The water toy and the puzzle pieces thereof provide for many hours of fun for a small child in the bathtub, at the beach, in a wading pool or a swimming pool.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENT

Figure 1:
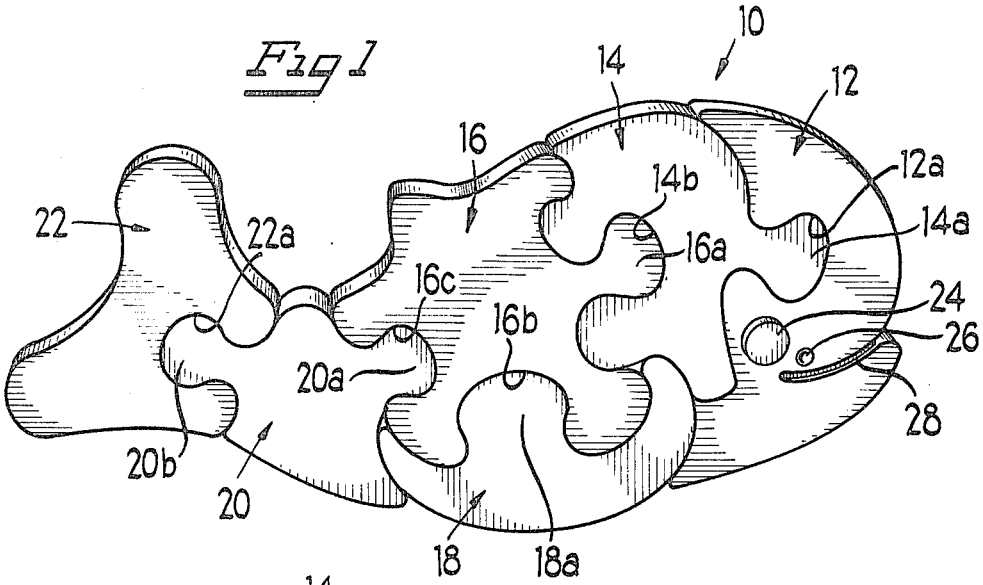
FIG. 1 is a side, elevational view of a new and improved water toy constructed in accordance with the present invention.
Figure 2:
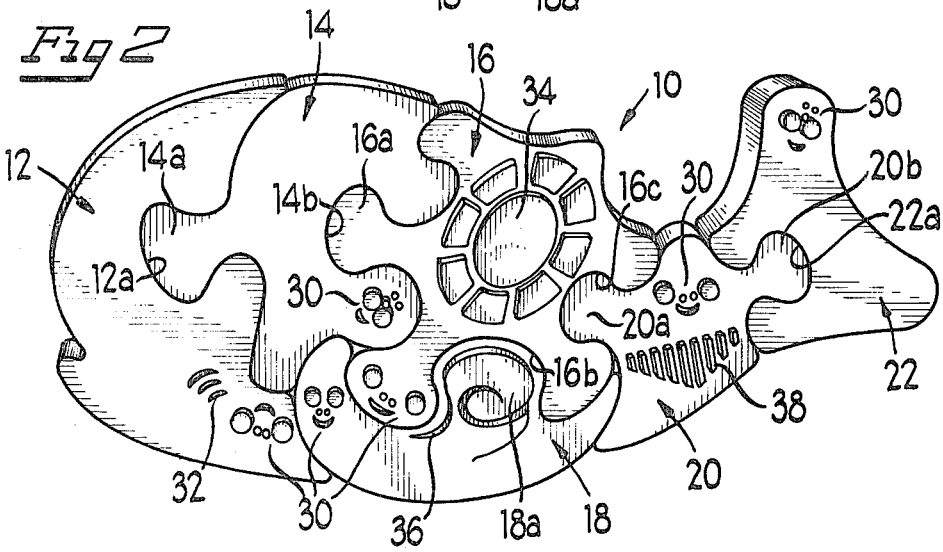
FIG. 2 is an elevational view of the toy of FIG. 1 from an opposite side.
Figure 3:
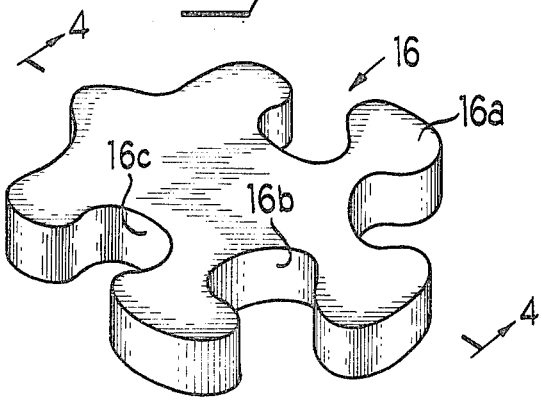
FIG. 3 is a perspective view of one of the individual puzzle pieces of the water toy.
Figure 4:
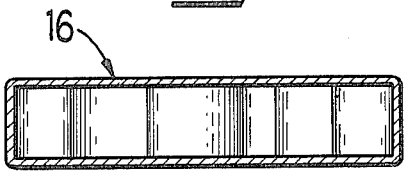
FIG. 4 is a transverse, sectional view taken substantially along line 4—4 of FIG. 3.

Referring now more particularly to the drawings, therein is illustrated a new and improved toy for use by children. In the preferred embodiment, a water toy is provided and designed for use by children in bathtubs, at the beach, and in wading pools or swimming pools. The water toy is referred to generally by the reference numeral 10 and includes a plurality of puzzle pieces 12, 14, 16, 18, 20 and 22, each of irregular shape or contour as shown and adapted to be removably interlocked together like a jigsaw puzzle in order to form the overall shape or profile of an object or creature, such as the whale shown in FIG. 1. The puzzle pieces are all formed of any lightweight, resilient material of substantial thickness such as blow molded or injection molded plastic, wood, foam or the like. In the embodiment shown (FIG. 4), the individual puzzle pieces are blow molded of plastic to form hollow, durable lightweight pieces. Because of the low density of the material, the assembled toy and the individual puzzle pieces will float in water. Once the puzzle pieces are assembled together in the proper relation as shown in the embodiment of FIGS. 1 and 2, the overall profile or outline that is formed closely resembles a whale. Of course, any type of animal or other object may be provided without departing from the concepts of the present invention.

Each of the puzzle pieces is provided with a substantial thickness so that they will tend to remain in an assembled together condition even when the toy 10 is floating in rough or wavy water. The puzzle pieces may fit loosely with one another so that the pieces may slide relative to one another due to the action of wavy water. The individual puzzle pieces are preferably blow molded of suitable material to the desired shape and thickness. Preferably, each includes a contoured outer edge having one or more internal recesses and/or outwardly extending projections adapted to closely interfit and interlock with an adjacent puzzle piece. For example, the puzzle piece 12 at the head of the whale, is formed with a recess 12*a* in which a projection 14*a* of the next adjacent puzzle piece is adapted to interfit to provide interlocking between the puzzle pieces 12 and 14. The puzzle piece 14 also includes a recess 14*b* in which is interfitted a projection 16*a* of the next adjacent puzzle piece 16. The puzzle piece 16 in turn is provided with recesses 16*b* and 16*c* adapted to receive projections 18*a* and 20*a* respectively, of the puzzle pieces 18 and 20. The puzzle piece 20 includes a projection 20*b* adapted to interfit in a recess 22*a* in the contoured edge of the tail forming piece 22.

The interlocking projections and/or recesses of the respective puzzle pieces provide positive means for holding together the puzzle pieces in the desired form such as that of a whale when the pieces are in the proper relation. As illustrated, an outside edge profile of the toy 10 as shown in FIGS. 1 and 2 resemble a whale or porpoiselike aquatic mammal.

As illustrated in FIG. 1, the head forming puzzle piece 12 of the whale is provided with decorations including a circular eye, a round dot 26 and a mouth 28 so that more realism is added. The flat side surfaces of the other puzzle pieces on the righthand side of the whale may not have any decorative material thereon other than a coloring of the surface and the overall appearance of the right side of the toy 10 as shown in FIG. 1, closely resembles a whale.

Referring to FIG. 2, the opposite or lefthand sides of the puzzle pieces are each provided with an individual animated face including a pair of eyes, a nose and a mouth and each individual puzzle pieces are contoured or shaped to a profile that resemble a variety of different objects or creatures.

In the preferred embodiment, the head forming puzzle piece 12 of the whale is shaped to resemble a "shark" or snake-like fish and in addition to the individual face 30, the lefthand side (as shown in FIG. 2) is provided with a decoration 32 resembling gill inlets. The puzzle piece 14 is shaped to resemble a sea-going mammal such as a "sea lion" or "walrus" and the puzzle piece 16 is shaped to resemble a "sea turtle" or "tortoise" and includes the design of a tortoise shell 34 (as shown in FIG. 2). The puzzle piece 18 represents a "sea serpent" or "eel-like" creature and is provided with a curved or coiled decorative stripe 36. The puzzle piece 20, in addition to an animated face 30, includes a decorative design 38 such as gill inlets on the chest or belly of the creature. The tail forming puzzle piece 22 is contoured or shaped to resemble a playful "seal" or similar sea-going mammal.

From the foregoing, it will be seen that when the individual puzzle pieces are assembled together as in the proper interlocked relation shown in FIGS. 1 and 2, the assembly has an outer profile resembling a whale or other creature and the righthand side thereof is provided with decoration or indicia and coloring to more closely resemble a whale or whale-like creature. The opposite or lefthand sides of the assembled puzzle pieces are decorated and contoured or shaped to provide a number of different individual creatures and these designs provide a variety of individual real or imaginary creatures for children to play with and use during play. Because of the lightweight material, the individual puzzle pieces and the assembly floats in water and because of the substantial thickness of the puzzle pieces, once they are assembled together, even when floating in water they do not readily become disassembled or separate even in rough or choppy waters.

The novel water toy as described is an interesting floating toy for young children and can provide many hours of entertainment. In addition, the puzzle water toy may be used to facilitate the teacing and learning of the identity, characteristics and shapes of various different aquatic animals. In addition, the aquatic puzzle toy may facilitate the development of manual coordination and dexterity of young children.

Although the present invention has been described with reference to a single illustrated embodiment of one shape, it should be understood that numerous other modifications, shapes and embodiments may be devised which will fall within the spirit and scope of the principles of this invention as defined in the attached claims.

What is claimed as new and desired to be secured by Letters Patent of the United States is:

1. A water toy comprising:

a plurality of puzzle pieces formed of generally lightweight material;

each of said puzzle pieces includes an outer contoured surface shaped to removably interlock with the contoured surface portion of an adjacent puzzle piece;

means for defining the contoured surface of the puzzle pieces in the form and shape of a creature, said puzzle pieces being shaped to cumulatively form a predetermined outer profile such as that of a creature or the like when assembled with their contoured surfaces in proper interlocked relation.

2. The water toy of claim 1 wherein said puzzle pieces are formed to have a pair of opposite sides with a substantial thickness between said opposite sides defining interlocking edges whereby said pieces maintain assembly with one another when floating in said assembled relation.

3. The water toy of claim 2 wherein at least the interlocking edges of said puzzle pieces are sized to permit relative movement therebetween in response to the action of the surface of moving water.

4. The water toy of claim 1 wherein each of said puzzle pieces is decorated to provide an individual animated face on one of its sides, said pieces being shaped so that said one sides are on a common side when said pieces are assembled together in said properly interlocked relation to form said outer predetermined profile.

5. The water toy of claim 4 wherein said puzzle pieces are decorated on their sides opposite said one sides to resemble a side view of an aquatic creature when said pieces are assembled together in said properly interlocked relation.

6. The water toy of claim 5 wherein said predetermined profile is that of a whale.

7. The water toy of claim 5 wherein said decorations include animated faces having eyes, nose and mouth.

8. The water toy of claim 5 wherein one of said puzzle pieces is shaped and decorated on said one side to resemble a turtle.

9. The water toy of claim 5 wherein one of said puzzle pieces is shaped and decorated on said one side to resemble a shark.

10. The water toy of claim 5 wherein one or more of said puzzle pieces are shaped and decorated on said one side to resemble a sea-going mammal such as a seal.

11. The water toy of claim 5 wherein all of said puzzle pieces are shaped and decorated on said one side to resemble creatures that live in the water.

12. The water toy of claim 5 wherein one of said puzzle pieces is shaped with a portion of its outer profile resembling the head portion of said whale.

13. The water toy of claim 12 wherein another of said puzzle pieces is shaped with a portion of its outer profile resembling the tail portion of said whale.

14. The water toy of claim 12 wherein another of said puzzle pieces is shaped with a portion of its outer profile resembling the tail portion of said whale.

15. The water toy of claim 1 wherein individually each of said puzzle pieces is decorated on one side to represent a creature that lives in the water other than said predetermined profile by said assembled together properly interlocked puzzle pieces.

16. The water toy of claim 5 wherein one of said puzzle pieces is shaped and decorated on said one side to resemble a sea serpent.

17. A water toy, comprising:

a plurality of puzzle pieces formed of relatively lightweight material;

each of said puzzle pieces including means for defining contoured surfaces shaped in the form of creatures and to removably interlock with the contoured surfaces of another puzzle piece; and said puzzle pieces being formed so as to have a pair of generally opposite surfaces with substantial thickness therebetween to cumulatively form an outer periphery in the form of a recognizable creature whereby said pieces maintain assembly in said form.

18. The water toy of claim 17 wherein said puzzle pieces are shaped to form a predetermined outer profile when assembled.

19. The water toy of claim 18 wherein said predetermined outer profile is generally in the shape of an octopus.

* * * * *